US006767192B2

(12) United States Patent
Hablanian

(10) Patent No.: US 6,767,192 B2
(45) Date of Patent: Jul. 27, 2004

(54) VAPOR JET PUMP WITH EJECTOR STAGE IN FORELINE

(75) Inventor: Marsbed Hablanian, Wellesley, MA (US)

(73) Assignee: Varian, Inc., Palo Alto, CA (US)

( * ) Notice: Subject to any disclaimer, the term of this patent is extended or adjusted under 35 U.S.C. 154(b) by 0 days.

(21) Appl. No.: 10/290,866

(22) Filed: Nov. 7, 2002

(65) Prior Publication Data

US 2004/0091364 A1 May 13, 2004

(51) Int. Cl.[7] ..... F04B 9/00; F04B 19/24; F04B 23/08; F04B 5/22

(52) U.S. Cl. ..... 417/154; 417/53; 417/87; 417/152; 417/153; 417/163; 417/207; 417/208

(58) Field of Search ..... 417/53, 85, 87, 417/152, 153, 154, 165, 166, 163, 207, 208

(56) References Cited

U.S. PATENT DOCUMENTS 2,150,685 A * 3/1939 Hickman ..... 417/152
2,361,245 A * 10/1944 Stallmann ..... 417/154
2,386,298 A * 10/1945 Downing ..... 417/153
2,386,299 A * 10/1945 Downing ..... 417/154
2,464,369 A * 3/1949 Baxter ..... 417/153
2,465,590 A * 3/1949 Hickman ..... 417/152
2,696,344 A * 12/1954 Dixon ..... 417/154
2,714,484 A * 8/1955 Carr et al. ..... 417/153
4,845,360 A 7/1989 Landfors

OTHER PUBLICATIONS

Book by O.W. Eshbach entitled Handbook of Engineering Fundamentals, published by John Wiley & Sons, Inc., New York, 1936, pp. 7–50 to 7–51.

* cited by examiner

*Primary Examiner*—Justine R. Yu
*Assistant Examiner*—Timothy P. Solak
(74) *Attorney, Agent, or Firm*—Bella Fishman

(57) ABSTRACT

A vapor jet vacuum pump includes a housing having an inlet port and a foreline conduit, a vapor jet assembly within the housing, a vapor source for supplying a vapor to the vapor jet assembly, and at least one ejector stage. The ejector stage includes an ejector nozzle mounted in the foreline conduit and a fluid inlet located external to the housing and coupled by an ejector conduit to the ejector nozzle. The fluid inlet may be an air inlet for drawing in air at atmospheric pressure. The ejector stage may be driven by a backing pump coupled to the foreline conduit.

18 Claims, 3 Drawing Sheets

VAPOR JET PUMP WITH EJECTOR STAGE IN FORELINE

FIELD OF THE INVENTION

This invention relates to vapor jet vacuum pumps and, more particularly, to vapor jet vacuum pumps and methods of operating wherein one or more ejector stages are located in a foreline conduit.

BACKGROUND OF THE INVENTION

Vapor jet vacuum pumps, also known as diffusion pumps, are widely used for vacuum pumping of enclosed chambers to high vacuum. The basic components of a vapor jet vacuum pump include a housing having an inlet port and a foreline which functions as an exhaust port. The housing may include a generally cylindrical portion and a foreline conduit. The foreline conduit may be coupled to a roughing pump, or a backing pump. A vapor source in the form of a boiler assembly is sealed within the lower end of the housing. The boiler assembly includes a reservoir for a liquid, such as oil, and a heater for vaporizing the liquid. A vapor jet assembly mounted within the housing directs one or more annular vapor jets toward the housing wall, where the vapor is condensed. The condensed vapor returns to the liquid reservoir, and the cycle is repeated. The vapor jets drag gas molecules from the enclosed chamber to which the pump is attached, thereby vacuum pumping the chamber.

Prior art vapor jet vacuum pumps have utilized an ejector stage to increase the exhaust pressure of the pump. The ejector stage includes a nozzle that is mounted within the cylindrical portion of the housing assembly and is aligned with the foreline conduit. A portion of the vapor generated by the boiler assembly passes as a vapor stream through the nozzle into the foreline conduit. The stream of vapor drags gas molecules toward the exhaust port of the pump. See for example U.S. Pat. No. 4,845,360, issued Jul. 4, 1989 to Landfors.

Limiting power consumption is frequently an important issue in the operation of vapor jet vacuum pumps. Vapor jet vacuum pumps are very inefficient with respect to the work done to compress the pumped gas. At maximum throughput operation, the efficiency may be only 1% or 2%. Most energy is used for reheating and reevaporating the condensed oil vapor. Under some operating conditions, approximately half of the power consumed by the vapor jet vacuum pump may go to operating the ejector stage.

Accordingly, there is a need for improved vapor jet vacuum pumps and methods of operating vapor jet vacuum pumps.

SUMMARY OF THE INVENTION

According to a first aspect of the invention, a vapor jet vacuum pump is provided. The vapor jet vacuum pump comprises a housing having an inlet port and a foreline conduit, a vapor jet assembly within the housing, a vapor source for supplying a vapor to the vapor jet assembly, and an ejector stage including an ejector nozzle mounted in the foreline conduit and a fluid inlet located external to the housing and coupled by an ejector conduit to the ejector nozzle.

According to a further aspect of the invention, a method is provided for use in a vapor jet vacuum pump comprising a housing having an inlet port and a foreline conduit, a vapor jet assembly within the housing and a vapor source for supplying a vapor to the vapor jet assembly. The method comprises operating an ejector stage, including an ejector nozzle mounted in the foreline conduit and a fluid inlet located external to the housing and coupled by an ejector conduit to the ejector nozzle by causing fluid flow through the fluid inlet, the ejector conduit and the ejector nozzle.

According to another aspect of the invention, a vacuum pumping system is provided. The vacuum pumping system comprises a vapor jet vacuum pump comprising a housing having an inlet port and a foreline conduit, a vapor jet assembly within the housing, a vapor source for supplying a vapor to the vapor jet assembly, and an ejector stage including an ejector nozzle mounted in the foreline conduit and a fluid inlet located external to the housing and coupled by an ejector conduit to the ejector nozzle, and a backing pump coupled to the foreline conduit.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
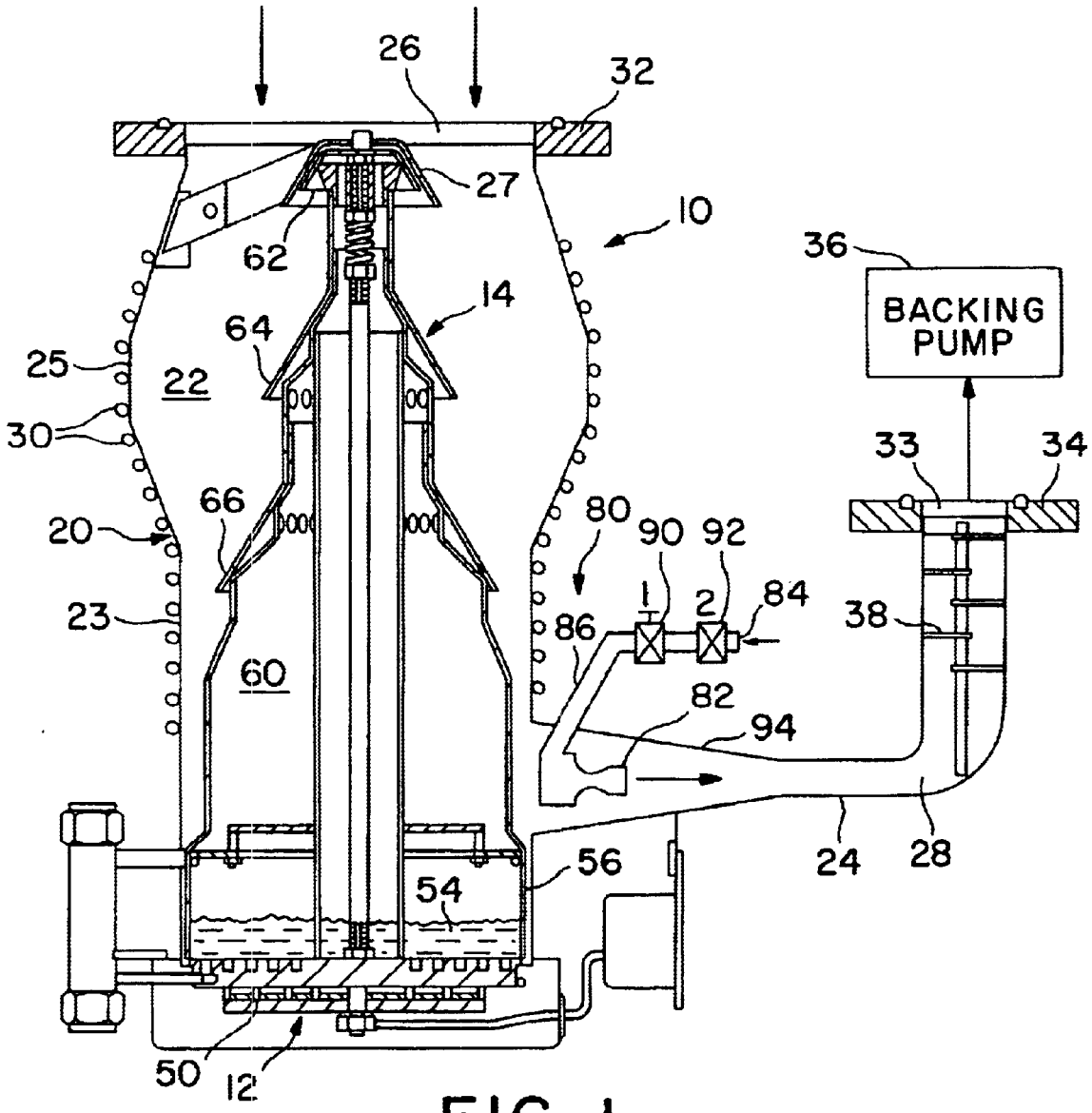
FIG. 1 is a simplified cross-sectional elevation view of a vapor jet vacuum pump in accordance with a first embodiment of the invention.

A simplified cross-sectional elevation view of a vapor jet vacuum pump in accordance with a first embodiment of the invention is shown in FIG. 1. Major components of the vapor jet vacuum pump include a housing 10, a vapor source in the form of a boiler assembly 12 and a vapor jet assembly 14.

The housing 10 includes a housing shell 20, or main housing body, which defines an interior region 22, and a foreline conduit 24, which defines a foreline 28. Shell 20 may, for example, include a cylindrical lower section 23 and an upper section 25 of increased diameter. An inlet port 26 coupled to interior region 22 is formed at the upper end of shell 20. A cold cap 27 mounted in inlet port 26 suppresses overdivergent flow, as known in the art. Cooling coils 30 may be provided on the outside surface of shell 20. The housing 10 may further include an inlet flange 32 for attachment of the pump to a vacuum chamber. The foreline conduit 24 defines an exhaust port 33 and includes a foreline flange 34. Foreline conduit 24 is typically attached to a backing pump 36. A baffle 38 located in the foreline conduit 24 improves condensation and inhibits loss of oil vapor through foreline 28.

The boiler assembly 12 is attached to the lower end of shell 20. The boiler 12 includes a heater 50 and a liquid reservoir 54 within a cylindrical wall 56 of vapor jet assembly 14.

The vapor jet assembly 14 has a generally cylindrical configuration which defines a central passage 60 that carries vapor from boiler assembly 12 to a first annular pumping stage 62, a second annular pumping stage 64 and a third annular pumping stage 66.

In operation, a liquid, such as oil, in reservoir 54 is vaporized by heater 50. The vapor passes upwardly through passage 60 to annular pumping stages 62, 64 and 66. Each of the pumping stages has an annular opening which directs the vapor outwardly and downwardly in a generally conical vapor jet. The vapor in each vapor jet is condensed by the relatively cool outer shell 20, and the condensed vapor returns to liquid reservoir 54. The vapor jets drag the gas molecules from the vacuum chamber to which the pump is attached, thereby vacuum pumping the chamber. The pumped gas molecules are exhausted through foreline 28.

According to an aspect of the invention, the vapor jet vacuum pump includes an ejector stage 80. Ejector stage 80 includes an ejector nozzle 82 mounted in foreline conduit 24. A fluid inlet 84 is located externally of housing 10. Fluid inlet 84 is coupled by an ejector conduit 86 to ejector nozzle 82. In the embodiment of FIG. 1, fluid inlet 84 is an air inlet and draws in air at atmospheric pressure. Ejector stage 80 may further include an adjustable valve 90, such as a needle valve, for adjusting air flow to ejector nozzle 82 and a shut-off valve 92 for controllably opening or closing ejector conduit 86. Adjustable valve 90 may be manually or automatically controlled, depending on the application. For example, valve 90 may be electrically controllable. Shut-off valve 92 may be configured and connected to automatically close if backing pump 36 stops operating, thereby preventing air at atmospheric pressure from entering the vapor jet vacuum pump. It will be understood that other valve arrangements may be utilized, or a fixed orifice may be utilized.

The ejector nozzle 82 is a known device in which the kinetic energy of one fluid is used to pump another fluid from a region of lower pressure to a region of higher pressure. Ejector nozzles are described for example by O. W. Eshbach in *Handbook of Engineering Fundamentals*, John Wiley and Sons, New York, 1936, pages 7–50 to 7-51. Ejector nozzles typically include a restriction which increases local flow velocity. Ejector nozzles are commercially available.

In some embodiments, ejector nozzle 82 may be mounted in a truncated conical section 94 of foreline conduit 24. In truncated conical section 94, foreline conduit 24 decreases in diameter with increasing distance from shell 20.

In the embodiment of FIG. 1, ejector stage 80 is powered by backing pump 36. In particular, air at atmospheric pressure of approximately 760 Torr is drawn into the ejector stage 80 through fluid inlet 84 and ejector conduit 86 to ejector nozzle 82. The air is ejected into foreline conduit 24 at a typical pressure on the order of 0.5 to 1.0 Torr. The air ejected from nozzle 82 flows through foreline conduit 24 to backing pump 36. The air flow draws gas molecules from the interior region 22 of housing 10, thereby functioning as a pumping stage. The ejector stage 80 produces a higher pressure at exhaust port 33 of the vapor jet vacuum pump than would be obtained in the absence of ejector stage 80.

Figure 2:
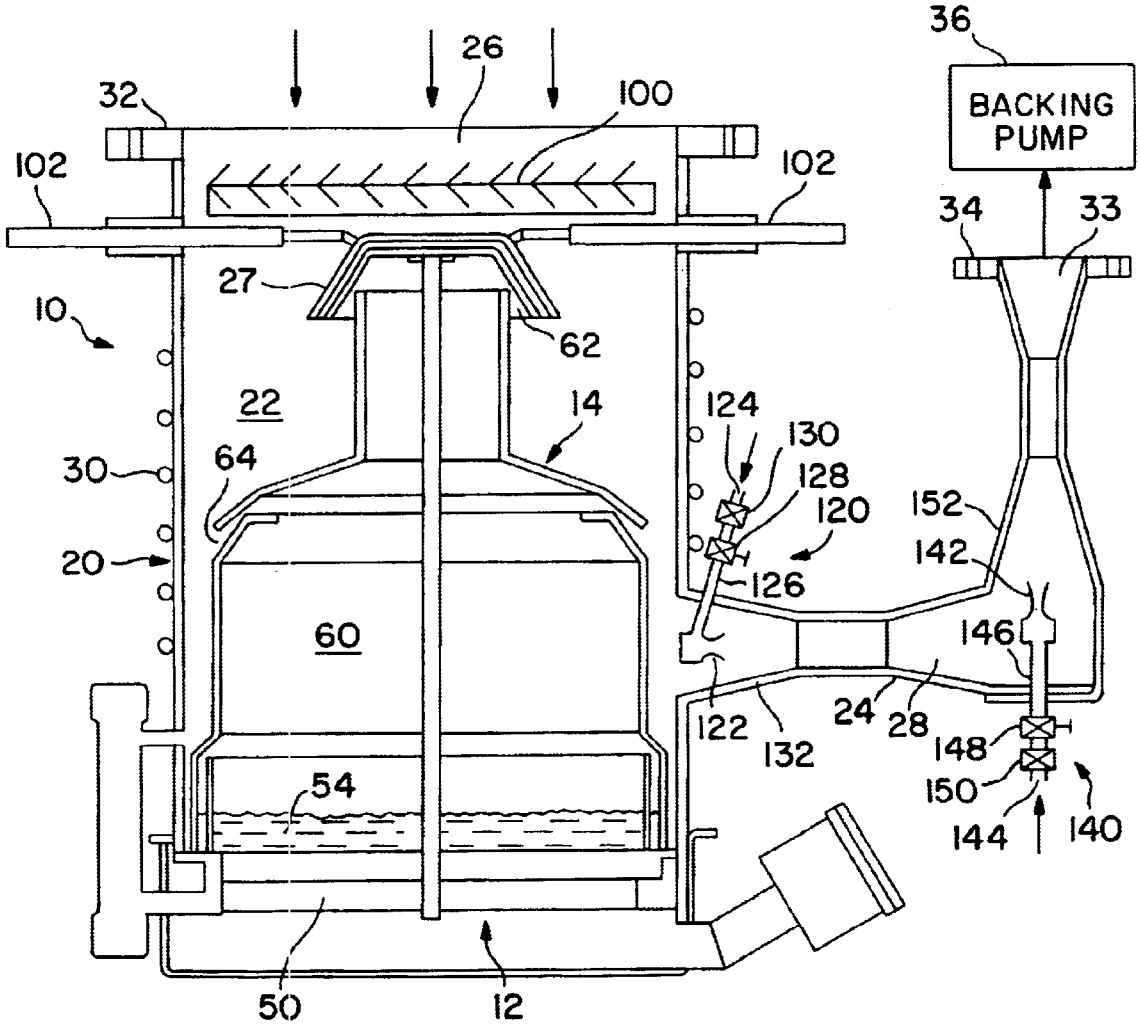
FIG. 2 is a simplified cross-sectional elevation view of a vapor jet vacuum pump in accordance with a second embodiment of the invention.

A simplified cross-sectional elevation view of a vapor jet vacuum pump in accordance with a second embodiment of the invention is shown in FIG. 2. Like elements in FIGS. 1 and 2 have the same reference numerals.

The vapor jet assembly 14 in the embodiment of FIG. 2 includes two annular pumping stages 62 and 64. In addition, the embodiment of FIG. 2 includes an optional baffle 100 and optional cooling conduits 102 coupled to cold cap 27.

The vapor jet vacuum pump shown in FIG. 2 includes a first ejector stage 120 and a second ejector stage 140 for increased pressure at exhaust port 33. Ejector stage 120 includes an ejector nozzle 122 mounted in foreline conduit 24, an air inlet 124 external to housing 10 and an ejector conduit 126 coupled between air inlet 124 and ejector nozzle 122. Ejector stage 120 may further include an adjustable valve 128 and a shut-off valve 130 connected in ejector conduit 126 between air inlet 124 and ejector nozzle 122. Ejector nozzle 122 may be mounted in a truncated conical section 132 of foreline conduit 24. Similarly, ejector stage 140 includes an ejector nozzle 142 mounted in foreline conduit 24, an air inlet 144 located external to housing 10 and an ejector conduit 146 coupled between air inlet 144 and ejector nozzle 142. Ejector stage 140 may further include an adjustable valve 148 and a shut-off valve 150 connected in ejector conduit 146 between air inlet 144 and ejector nozzle 142. Ejector nozzle 142 may be mounted in a truncated conical section 152 of foreline conduit 24. Truncated conical sections 132 and 152 of foreline conduit 24 decrease in diameter with increasing distance from housing shell 20. Ejector nozzle 142 is positioned in foreline conduit 24 downstream of ejector nozzle 122.

Ejector stages 120 and 140 operate in series in foreline conduit 24. Each of the ejector stages 120 and 140 is driven by backing pump 36. Air is drawn into each ejector stage through the respective air inlet at atmospheric pressure and is discharged by the ejector nozzle at the pressure in foreline conduit 24 at the location of the respective ejector nozzle. As a result, ejector stage 120 produces an increase in pressure and ejector stage 140 produces a further increase in pressure. It will be understood that more than two ejector stages may be utilized in series. Furthermore, the truncated conical sections 132 and 152 of foreline conduit 24 may be replaced with cylindrical sections or sections of other suitable shape.

It may be noted that the vapor jet vacuum pumps shown in FIGS. 1 and 2 do not include an ejector which is part of the vapor jet assembly and which is driven by vapor from the boiler assembly. Thus, the power consumption of the vapor jet pumps of FIGS. 1 and 2 is reduced in comparison with prior art vapor jet pumps that do include such an ejector. The one or more ejector stages in the foreline conduit produce an exhaust port pressure that is comparable to or greater than prior art vapor jet vacuum pumps, with reduced power consumption by the vapor jet vacuum pump.

The ejector stages 120 and 140 place an increased load on backing pump 36. However, typical mechanical backing pumps have a more or less constant input power as a function of inlet pressure. Accordingly, the power drawn by backing pump 36 is not appreciably increased by the increased inlet pressure resulting from the addition of one or more ejector stages in the vapor jet vacuum pump.

Figure 3:
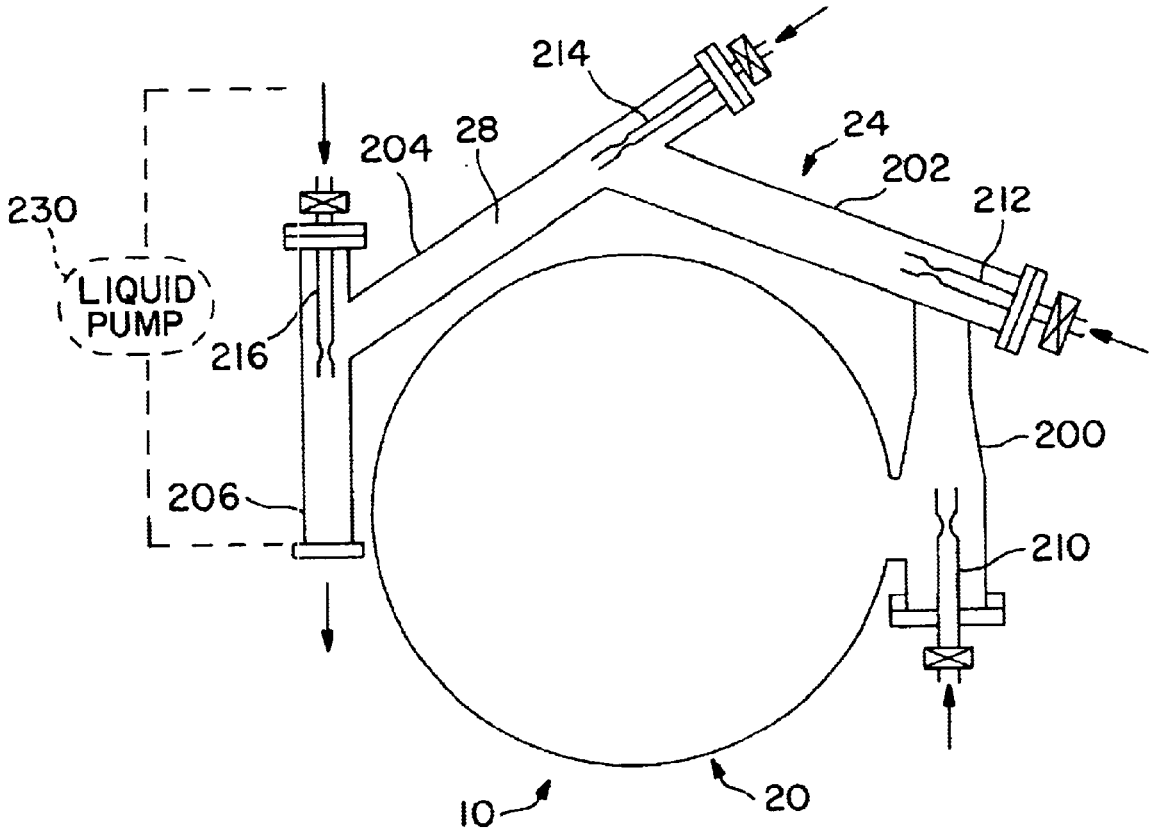
FIG. 3 is a simplified cross-sectional top view of a vapor jet vacuum pump in accordance with a third embodiment of the invention.

A simplified cross-sectional top view of a vapor jet vacuum pump in accordance with a third embodiment of the invention is shown in FIG. 3. Like elements in FIGS. 1–3 have the same reference numerals. In the embodiment of FIG. 3, housing shell 20 is shown schematically, and the vapor jet assembly and the vapor source are omitted for ease of illustration.

In the embodiment of FIG. 3, foreline conduit 24 includes foreline conduit sections 200, 202, 204 and 206, which are wrapped around housing shell 20 to provide a compact structure. Each of the foreline conduit sections is provided with an ejector stage. Thus, foreline conduit section 200 is provided with an ejector stage 210, foreline conduit section 202 is provided with an ejector stage 212, foreline conduit section 204 is provided with an ejector stage 214 and foreline conduit section 206 is provided with an ejector stage 216. Each of the ejector stages 210, 212, 214 and 216 may include an ejector nozzle located in the respective foreline conduit section, an air inlet located external to housing 10 and an ejector conduit coupled between the air inlet and the ejector nozzle, as described above. Each ejector stage may further include an adjustable valve and a shut-off valve as described above. The vapor jet vacuum pump embodiment of FIG. 3 thus provides four ejector stages in series to produce a relatively high output pressure. It will be understood that any number of ejector stages can be utilized within the scope of the invention. Furthermore, the foreline conduit 24 is not necessarily configured in sections as shown in FIG. 3. In other embodiments, a continuous foreline conduit having one or more ejector stages located at intervals may be provided.

A further embodiment of the invention is described with reference to FIG. 3. One or more of the ejector stages may be configured for operation with a liquid. In the embodiment of FIG. 3, the inlet of ejector stage 216 may be connected to a liquid pump 230. Pump 230 may supply a liquid, such as water or oil, to ejector stage 216. The liquid passes through the ejector nozzle in the form of a spray and pumps gas molecules in the same manner as the air ejector stage described above. The liquid may be collected in foreline conduit section 206, such as by gravity, and returned to liquid pump 230 to form a recirculating liquid ejector stage. The liquid ejector stage is driven by liquid pump 230 rather than by backing pump 36. In some embodiments, the liquid ejector stage can have a dedicated supply of a liquid, such as oil or water. In other embodiments, the liquid for the liquid ejector stage can be drawn from reservoir 54 (FIGS. 1 and 2) of boiler assembly 12 and returned to reservoir 54 after passing through the ejector stage.

It will be understood that the vapor jet vacuum pump may have any suitable housing configuration, any suitable vapor jet assembly configuration and any suitable boiler assembly configuration within the scope of the invention. Furthermore, the vapor jet vacuum pump may include an ejector which is part of the vapor jet assembly and which is driven by vapor from the boiler assembly, as disclosed in the aforementioned U.S. Pat. No. 4,845,360, in addition to the one or more ejector stages as described above. The one or more ejector stages may be built into the foreline conduit to form an integral part of the vapor jet vacuum pump.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. In a vapor jet vacuum pump comprising a housing having an inlet port and a foreline conduit, a vapor jet assembly within the housing and a vapor source for supplying a vapor to the vapor jet assembly, a method comprising:

operating an ejector stage, including an ejector nozzle mounted in the foreline conduit and a fluid inlet located external to the housing and coupled by an ejector conduit to the ejector nozzle, by causing fluid supplied with an atmospheric air to flow through the fluid inlet, the ejector conduit and the ejector nozzle.

2. The method as defined in claim 1, wherein operating an ejector stage further comprises pumping the air with a backing pump coupled to the foreline conduit.

3. The method as defined in claim 2, wherein operating an ejector stage further comprises adjusting air flow to the ejector nozzle.

4. The method as defined in claim 1, wherein operating an ejector stage comprises supplying a liquid through the fluid inlet and the ejector conduit to the ejector nozzle.

5. A vapor jet vacuum pump comprising:

a housing having an inlet port and a foreline conduit;

a vapor jet assembly within the housing;

a vapor source for supplying a vapor to said vapor jet assembly; and an ejector stage including an ejector nozzle mounted in the foreline conduit and a fluid inlet having an air inlet, said fluid inlet located external to the housing and coupled by an ejector conduit to the ejector nozzle, wherein the ejector stage is driven by a backing pump coupled to the foreline conduit.

6. The vapor jet vacuum pump as defined in claim 5 wherein the ejector stage further comprises an adjustment valve connected in the ejector conduit between the air inlet and the ejector nozzle.

7. The vapor jet vacuum pump as defined in claim 5 wherein the ejector stage further comprises a shut-off valve connected in the ejector conduit between the air inlet and the ejector nozzle.

8. The vapor jet vacuum pump as defined in claim 5, wherein said ejector stage further comprises a liquid source coupled to the fluid inlet.

9. The vapor jet vacuum pump as defined in claim 5, further comprising one or more additional ejector stages, each including an ejector nozzle mounted in the foreline conduit and a fluid inlet located external to the housing and coupled by an ejector conduit to the ejector nozzle.

10. The vapor jet vacuum pump as defined in claim 9, wherein the housing includes a main housing body and wherein said ejector stages are disposed around the main housing body.

11. The vapor jet vacuum pump as defined in claim 5, wherein said vapor jet assembly comprises one or more annular vapor jet stages, each directing a vapor jet toward the housing.

12. The vapor jet vacuum pump as defined in claim 11, wherein said vapor jet assembly further comprises a central passage for delivering a vapor from said vapor source to the one or more annular vapor jet stages.

13. The vapor jet vacuum pump as defined in claim 12, wherein said vapor source comprises a boiler assembly located in a base of the housing.

14. A vacuum pumping system comprising:

a vapor jet pump comprising a housing having an inlet port and a foreline conduit, a vapor jet assembly within the housing, a vapor source for supplying a vapor to the vapor jet assembly, and an ejector stage including an ejector nozzle mounted in the foreline conduit and a fluid inlet, said fluid inlet comprising an air inlet and located external to the housing and coupled by an ejector conduit to the ejector nozzle; and a backing pump coupled to the foreline conduit.

15. The vacuum pumping system as defined in claim 14, wherein the ejector stage further comprises an adjustable valve located in the ejector conduit between the air inlet and the ejector nozzle.

16. The vacuum pumping system as defined in claim 15, wherein the ejector stage further comprises a shut-off valve located in the ejector conduit between the air inlet and the ejector nozzle.

17. The vacuum pumping system as defined in claim 14, wherein the vapor jet pump further comprises one or more additional ejector stages, each including an ejector nozzle mounted in the foreline conduit and a fluid inlet coupled by an ejector conduit to the ejector nozzle.

18. The vacuum pumping system as defined in claim 14, wherein the ejector stage further includes a liquid source coupled to the fluid inlet.

* * * * *